US005748566A

United States Patent [19]

Goodson

[11] Patent Number: 5,748,566

[45] Date of Patent: May 5, 1998

[54] ULTRASONIC TRANSDUCER

[75] Inventor: J. Michael Goodson, Skillman, N.J.

[73] Assignee: Crest Ultrasonic Corporation, Trenton, N.J.

[21] Appl. No.: 644,843

[22] Filed: May 9, 1996

[51] Int. Cl.[6] ..... H04R 17/00

[52] U.S. Cl. ..... 367/158; 367/162; 367/176; 310/328; 310/322; 310/334

[58] Field of Search ..... 367/162, 158, 367/176; 310/328, 322, 334

[56] References Cited

U.S. PATENT DOCUMENTS

| | | | |
|---|---|---|---|
| 3,575,383 | 4/1971 | Coleman | 259/72 |
| 4,129,850 | 12/1978 | Mumper | 367/162 |
| 4,219,889 | 8/1980 | Parssinen et al. | 367/158 |
| 4,633,119 | 12/1986 | Thompson | 310/325 |

*Primary Examiner*—J. Woodrow Eldred
*Attorney, Agent, or Firm*—Limbach & Limbach, LLP

[57] ABSTRACT

This invention relates to an ultrasonic generator apparatus for generating and transmitting enhanced ultrasonic wave energy of a predetermined frequency to a liquid confined in a container which contains a resonance enhancing disc. Such electroacoustic transducer apparatus or generators are utilized in ultrasonic cleaning equipment. The apparatus are mounted to the side or the underside of the liquid container or mounted in a sealed enclosure which is immersed in a liquid in a container made of metal, plastic or glass. Generators are used in single or plurality of to energize the liquid with sonic energy which in turn transformed into cavitations. In the present invention, the insertion of a resonance enhancing disc between the base of the generator and the piezo electric material provides an increase in intensity of the resonant frequency signals, diminishing periodical shift in frequency and stabilizing piezo electric material temperature.

10 Claims, 2 Drawing Sheets

ULTRASONIC TRANSDUCER

BACKGROUND OF THE INVENTION

Ultrasonic generators are used for generating and transmitting ultrasonic wave energy of a predetermined frequency to a liquid contained in a container. See, for example, John A. Coleman, U.S. Pat. No. 3,575,383: "Ultrasonic Cleaning System, Apparatus and Method Therefore"; see also Applicants' Vibra Bar Module technology, shown in FIG. 1. Generators of this type are used in ultrasonic cleaning equipment. The generator is typically mounted to the side or the underside of a container which holds liquid, or mounted in a sealed enclosure which is immersed in a liquid in a container made of metal, plastic or glass. Single generators or a plurality of generators are then used to energize the liquid with sonic energy. Once energized with the sonic energy, the liquid achieves cavitation.

Previous generators as shown in FIG. 1 were known to include a rectangular base 1, a pair of electrodes 2, a piezo electric crystal 3, an insulator 4, a reflector 5, washers 6 and a bolt 7. It has been observed though, that when energized by a high frequency power supplier, generators of the type described above produced weaker vibrations in the desired frequencies of 20–100 KHz. The generators evidenced a further problem in that the ultrasonic frequency in the desired range of 25–35 KHz, 40–50 KHz, 60–70 KHz had a tendency to shift +/–3 KHz due to various external factors. This shift required adjusting of the frequency of the electronic oscillatory circuit which energizes the transducers from time to time in order to match the shift.

The problem is that an increase in the temperature of a piezo electric crystal results from out of phase oscillation, and it is known that the piezo electric crystals cease to function when their temperature reaches their Curie point, and there is the further possibility of a permanent degradation.

OBJECTS AND SUMMARY OF THE INVENTION

Thus, it is the general object of this invention to provide an enhanced ultrasonic generator apparatus.

It is another object of the invention to provide an enhanced generator which produces stable predetermined frequencies.

It is still a further object of the invention to diminish the periodic shift in frequencies produced by the generator, and to thus stabilize the temperature of the piezo electric crystals.

To that end, the present invention provides an ultrasonic generator which includes a resonance enhancing disc. The disc, constructed either of a conductive or non-conductive material is inserted in the generator between the piezo electric crystal and the base of the generator. This relative placement of the disc increases the efficiency of the generator, allowing it to produce stable predetermined frequencies.

DESCRIPTION

Figure 1:
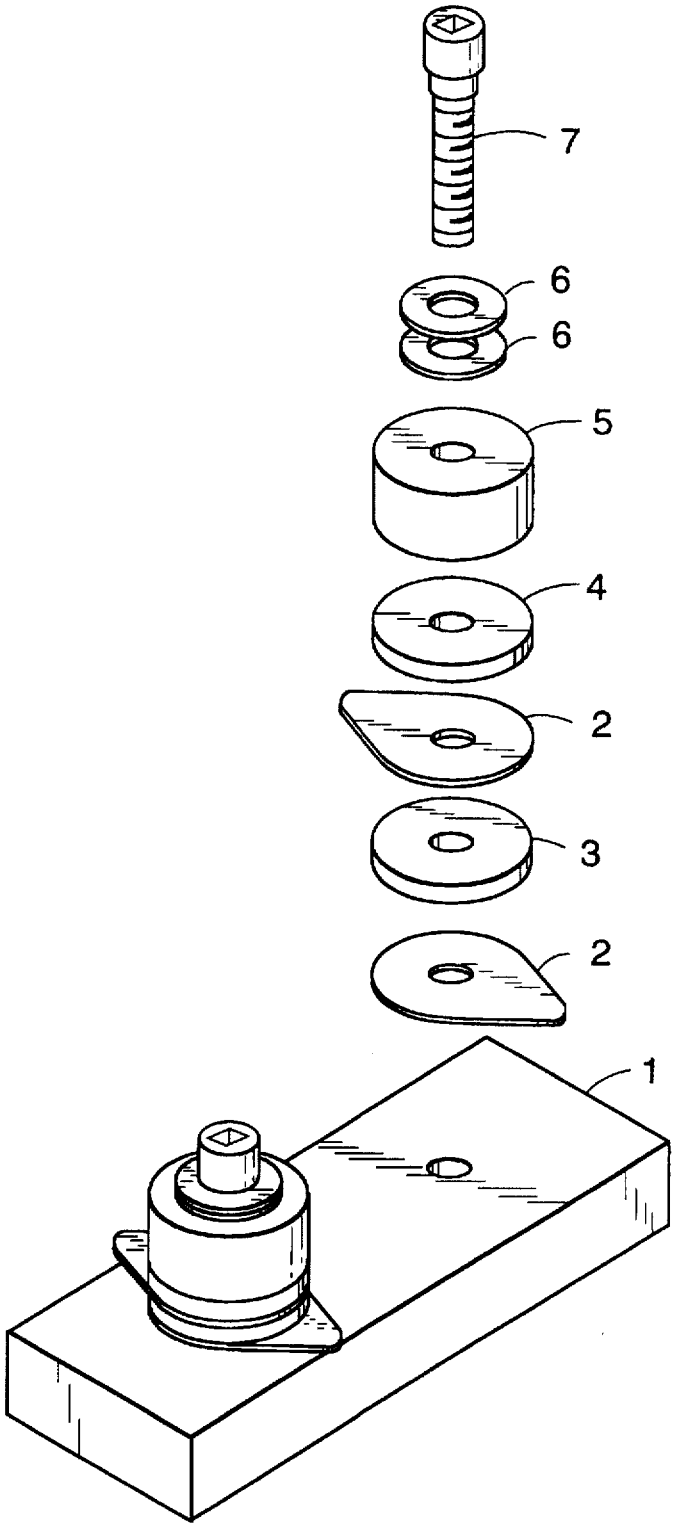
FIG. 1 (PRIOR ART)
FIG. 1 is an exploded view of the prior art.
Figure 2:
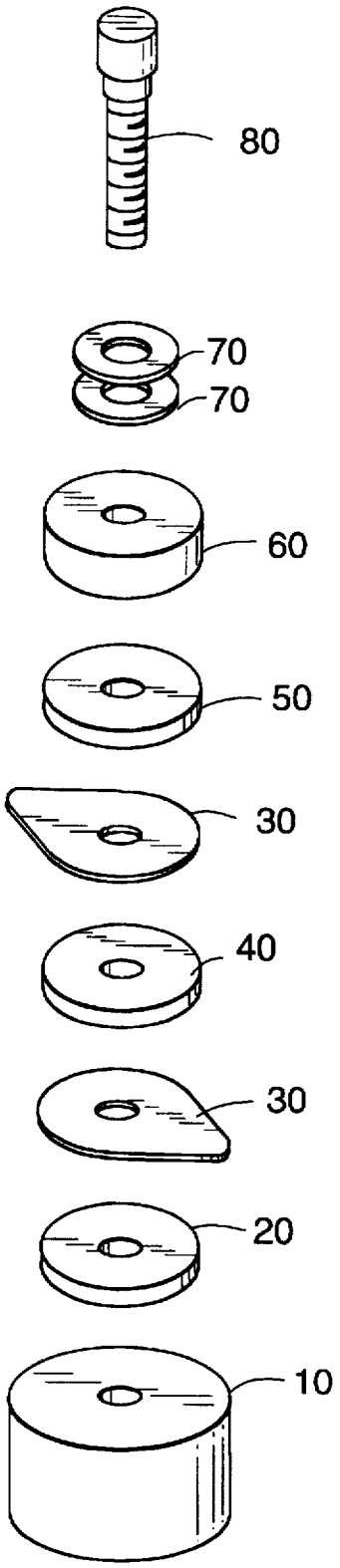
FIG. 2 is an exploded view of an embodiment of the present invention.

An ultrasonic enhanced transducer (or generator), according to the present invention, is shown in FIG. 2. The transducer comprises a base 10, a resonance enhancing (or resonator) disc 20, electrodes 30, a piezo electric crystal 40, an insulator 50, a reflector 60, washers 70, and a bolt 80.

Starting from the bottom of the structure in FIG. 2, the cylindrical base 10, which is made of a suitable metal, typically aluminum, is capable of being bonded to the wall of a container which holds liquid. Coupled to the base 10 is a resonance enhancing disc 20 which can be made of conductive or non-conductive material including, but not limited to, aluminum, ceramic material, stainless steel or leaded steel. Next is the first of two metal electrodes 30, followed by a piezo electric crystal 40. The crystal 40 is typically made of lead zirconate titanate, and is 0.50–4.00 inches in diameter, and 0.10–0.50 inches thick. On the opposite side of the crystal is another metal electrode 30, which is followed by a dielectric insulator 50. On the opposite side, adjacent to the insulator 50 is a metal reflector 60 which is typically cylindrical in shape, and made of steel or leaded steel. Lastly, the apparatus is provided with washers 70, and a bolt 80. All of the above listed components are assembled and coupled to the base 10 by tightening the bolt 80 to a torque pressure of 150–400 inch-pounds. Optimally, that pressure is between 200–300 inch-pounds.

The thickness of each the base 10, the resonance enhancing disc 20 and the reflector 60 is an integral multiple of ¼ the wavelength (lambda/4) of the longitudinal sound vibrations in the medium.

The insertion of the conductive or nonconductive resonance enhancing disc 20 in between the piezo electric crystal 40 and the base 10 of the generator increases the intensity of the resonant frequency signals by 30–40%. The periodical shift in frequency diminished, and the temperature of the piezo electric crystals stabilized.

The insertion of the new resonance enhancing disc 20, also results in new resonant frequencies emerging in lieu of or in addition to the original resonant frequencies. For example, by inserting a 0.20 inch alumina ceramic resonator, frequencies of 59 KHz, 101 KHz, 160 KHz emerged in lieu of 46 KHz, 122 KHz and 168 KHz. The substitution of other resonance enhancing discs made of materials like stainless steel, aluminum and paramagnetic leaded steel produced similar results.

Resonance enhancing discs comprised of ceramics and those comprised of metals which were placed in the new generators increased the intensity of all the original resonant frequencies by about 30–60%, as measured by the decrease in the piezo electric impedance (ohms) in the new generator assemblies. This enhancement greatly increases the efficiency of an ultrasonic generator and allows it to produce stable predetermined frequencies. It should be noted that a resonance enhancing disc made of a polymeric material, specifically high density teflon, however did not function to increase the intensity of the original resonant frequencies as did the discs made of metals and ceramics. Without being bound by a particular theory, it is believed that materials such as high density teflon attenuate, rather than transmit, ultrasonic energy. Thus, those materials which will be useful as resonance enhancing disks would not encompass such attenuating materials, but would include any material which functions to increase the intensity of the original resonant frequencies.

What is claimed is:

1. An apparatus for generating and transmitting ultrasonic wave energy comprising:

a base;

a piezo electric material;

a resonance enhancing disc formed of a ceramic material and positioned between the base and the piezoelectric material;

an electrode electrically coupled to the piezo electric material;

and a reflector positioned adjacent to the piezo electric material on a side opposite the resonance enhancing disc.

2. The apparatus of claim 1 wherein the ceramic material of the resonance enhancing disc is alumina ceramic.

3. An apparatus for generating and transmitting ultrasonic wave energy comprising:

a base;

a piezo electric material;

a resonance enhancing disc positioned between the base and the piezo electric material, wherein the resonance enhancing disc is comprised of ceramic;

a first electrode positioned between the resonance enhancing disc and the piezo electric material;

an insulator;

a second electrode positioned between the resonance enhancing disc and the insulator;

a reflector positioned adjacent to the insulator on a side not occupied by the second electrode.

4. The apparatus of claim 3 wherein the material of the resonance enhancing disc is alumina ceramic.

5. An apparatus for generating and transmitting ultrasonic wave energy comprising:

a metallic base;

a piezo electric crystal;

a resonance enhancing disc positioned between the metallic base and the piezo electric crystal, wherein the resonance enhancing disc is comprised of ceramic;

a first metallic electrode positioned between the resonance enhancing disc and the piezo electric crystal;

a dielectric insulator;

a second metallic electrode positioned between the resonance enhancing disc and the dielectric insulator;

a steel reflector positioned adjacent to the dielectric insulator on a side not occupied by the second metallic electrode.

6. The apparatus of claim 5 wherein the piezo electric crystal is comprised of lead zirconate-titanate.

7. The apparatus of claim 5 wherein the material of the resonance enhancing disc is alumina ceramic.

8. An apparatus for generating and transmitting ultrasonic wave energy comprising:

a base;

a ceramic disc having one side in contact with the base;

a piezo electric crystal positioned adjacent the ceramic disc on a side opposite the base;

electrode means for supplying electrical power to the piezo electric crystal; and a reflector positioned adjacent the piezo electric crystal on a side opposite the ceramic disc.

9. The apparatus of claim 8 wherein the base has a tapped hole; the ceramic disc, piezo electric crystal, and reflector each have a hole therethrough; wherein the ceramic disc, piezo electric crystal, and reflector are arranged in a stack on the base; and further comprising a bolt that extends through the holes of the reflector, piezo electric crystal, and ceramic disc and is threaded into the tapped hole of the base to secure the stack to the base.

10. The apparatus of claim 8 wherein the ceramic disc is composed of alumina ceramic.

* * * * *